US005957707A

United States Patent [19]

Kodama

[11] Patent Number: 5,957,707

[45] Date of Patent: Sep. 28, 1999

[54] AUTOMATIC CONNECTOR MUTUALLY-FITTING MECHANISM

[75] Inventor: Shinji Kodama, Shizuoka, Japan

[73] Assignee: Yazaki Corporation, Tokyo, Japan

[21] Appl. No.: 08/921,461

[22] Filed: Sep. 2, 1997

[30] Foreign Application Priority Data

Sep. 2, 1906 [JP] Japan ..... 8-231889

[51] Int. Cl.[6] ..... H01R 13/62

[52] U.S. Cl. ..... 439/157; 439/152

[58] Field of Search ..... 439/157, 152, 439/153, 159, 296, 297, 298, 299, 342, 345, 347, 595, 692, 34–36

[56] References Cited

U.S. PATENT DOCUMENTS 5,169,327 12/1992 Hatagishi ..... 439/157
5,499,926 3/1996 Akeda ..... 439/157
5,551,885 9/1996 Yamanashi et al. ..... 439/157
5,562,465 10/1996 Taguchi et al. ..... 439/157

FOREIGN PATENT DOCUMENTS 6-243928 9/1994 Japan .

*Primary Examiner*—Lincoln Donovan
*Attorney, Agent, or Firm*—Morgan, Lewis & Bockius LLP

[57] ABSTRACT

An automatic connector mutually-fitting mechanism in which a pair of connectors to be fitted together are mounted respectively on separate structural members, and the connectors are fitted together by connecting the structural members together. A male connector is projectably and retractably mounted movably in a connector guide groove of an instrument panel, a female connector is fixedly mounted on a gauge board, and a fitting lever having a cam groove is movably mounted on the gauge board. In a process of connecting the gauge board to the instrument panel, the fitting lever is moved relative to the gauge board, with a front end of the fitting lever abutted against an inner surface of the instrument panel, so that a driven pin of the male connector, fitted in the cam groove, is driven, thereby fitting the two connectors together.

18 Claims, 10 Drawing Sheets

AUTOMATIC CONNECTOR MUTUALLY-FITTING MECHANISM

BACKGROUND OF THE INVENTION

1. Field of the Invention

This invention relates to an automatic connector mutually-fitting mechanism in which a pair of connectors, used mainly in electric wiring in an automobile, are mounted respectively on separate structural members, and are fitted together by connecting the structural members together.

2. Description of the Related Art

One example of connectors for connecting a wire harness, used in electric wiring in an automobile, includes a lever connecting-type connector (disclosed in Japanese Patent Unexamined Publication No. Hei. 6-243928) shown in FIG. 13, in which a pair of connectors a and b are fitted together and disengaged from each other by pivotally moving a lever c. In such a lever connecting-type connector, the connectors a and b are fitted together by pivotally moving the lever c, and therefore there are advantages that the fitting force is reduced and that the positioning for fitting purposes is easy.

However, as shown in FIG. 14, when the lever connecting-type connectors a and b are used so as to connect a wire harness e in an instrument panel d of the automobile to electric wiring in a gauge board f to be mounted on the instrument panel d, the connector b, connected to an end of the wire harness e, is drawn from the instrument panel d, and then is fitted into the connector a mounted on the gauge board f. Then the gauge board f is mounted on the instrument panel d.

Therefore, the wire harness e must have an excess length so that the wire harness can be pulled to extend exteriorly of the instrument panel d to permit the connecting operation, which results in a disadvantage in that the cost of the member, as well as the weight, is inevitably increased. Besides, when mounting the gauge board f on the instrument panel d, there is a possibility that the wire harness e is caught or bitten between the instrument panel d and the gauge board f, and in such a case this mounting operation can not be carried out, and also the wire harness e may be damaged.

On the other hand, in order to simplify the fitting operation, there has been proposed a method as shown in FIG. 15, in which a receiving connector h is movably mounted on an inner wall d' of an instrument panel through spring pieces g, and a connector a' on a gauge board f' is fitted on the receiving connector h simultaneously when connecting the gauge board f' to the instrument panel.

However, when fitting the connector a', mounted on the gauge board f', on the receiving connector h, a fitting load acts directly on the receiving connector h, and therefore the instrument panel must be reinforced so as to withstand the fitting load. If this reinforcement is effected, there is encountered a problem that the instrument panel is increased in size and weight, and as a result, the weight of a vehicle body increases, and also the handling of the instrument panel is cumbersome.

SUMMARY OF THE INVENTION

This invention has been made in view of the above problems, and an object of the invention is to provide an automatic connector mutually-fitting mechanism in which an operation, in which a wire harness is drawn out, and connectors are manually fitted together, does not need to be effected, and a manual operation of a fitting lever does not need to be effected, and instead the connectors can be fitted together by an operation of mutually connecting structural members having the connectors beforehand mounted thereon, respectively.

In order to achieve the above object, the invention provides an automatic connector mutually-fitting mechanism comprising: two structural members to be connected together; two connectors to be fitted together, one of the connectors being projectably and retractably mounted movably on one of the structural members, a driven pin being formed on and projecting from a housing of the one connector, and the other of the connectors being fixedly secured to the other of the structural members in opposed relation to the one connector; a fitting lever having a cam groove and movably mounted on the other structural member, wherein in a process of connecting the structural members together, the one connector is moved together with the other structural member, and the fitting lever is moved relative to the other structural member, with one end of the fitting lever abutted against a wall of the one structural member, so that the driven pin fitted in the cam groove is driven, thereby fitting the connectors together.

DETAILED DESCRIPTION OF THE PREFERRED EMBODIMENTS

A preferred embodiment of the present invention will now be described.

Figure 1:
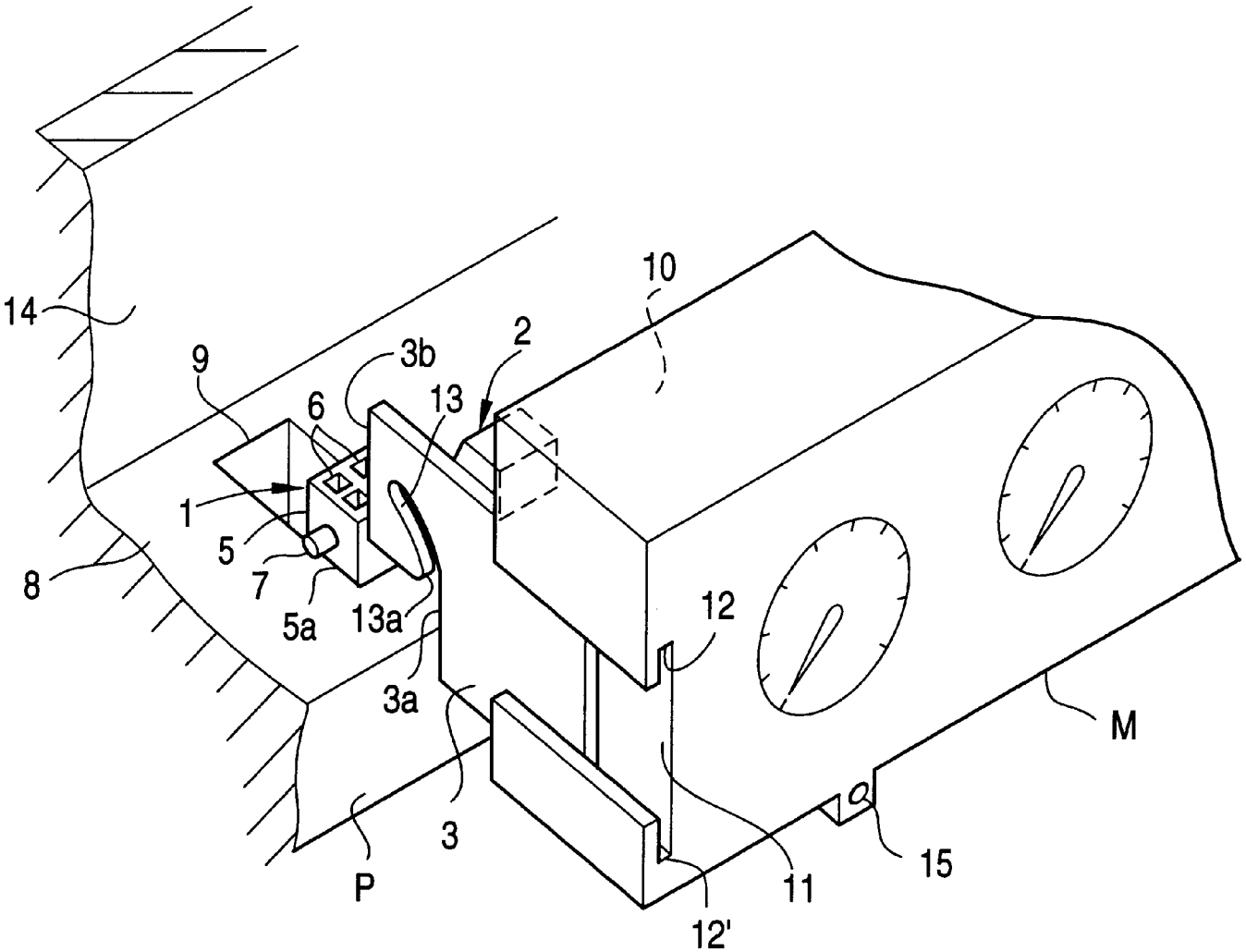
FIG. 1 is a perspective view showing a preferred embodiment of an automatic connector mutually-fitting mechanism of the present invention applied to an instrument panel and a gauge board.

FIG. 1 is a perspective view showing an automatic connector fitting mechanism of the invention applied to an instrument panel (structural member) P of an automobile and a gauge board (structural member) M to be connected to the instrument panel P.

The connector fitting mechanism of this embodiment comprises a male connector 1 projectably and retractably mounted on the instrument panel P, a female connector 2 fixedly mounted on a rear surface of the gauge board M, and a fitting lever 3 removably mounted on a side wall of the gauge board M.

The male connector 1 includes a housing 5 which is molded of a synthetic resin, and has a box-shape of a square cross-section, and the housing 5 has a plurality of terminal receiving chambers 6 formed therein. Female metal terminals (not shown) are mounted respectively in the terminal receiving chambers 6, and a driven pin 7 is formed on and projects from a side surface 5*a* of the housing 5.

The male connector 1 is projectably and retractably mounted movably in a connector guide groove 9 formed in a bottom wall 8 of a connecting portion of the instrument panel P, the connector guide groove 9 being directed in a direction of mounting of the gauge board M.

The female connector 2 is molded of a synthetic resin, and has a tubular body of a square cross-section for receiving the housing 5 of the male connector 1, and a plurality of male metal terminals (not shown) are mounted in the female connector 2. The female connector 2 is fixedly mounted on a rear surface 10 of the gauge board M, and is directed downwardly so as to be opposed to the male connector 1.

The fitting lever 3 is in the form of a flat plate, and is movably mounted in opposed guide grooves 12 and 12' formed in a side wall 11 of the gauge board M. One end portion of the fitting lever 3 has a stepped configuration, and a cam groove 13 is formed in the fitting lever 3, and extends toward an upper edge 3*b*, the cam groove 13 having an inlet portion 13*a* directed to a lower edge 3*a*.

A process of fitting the two connectors 1 and 2 together by connecting the gauge board M to the instrument panel P will now be described.

Figure 2:
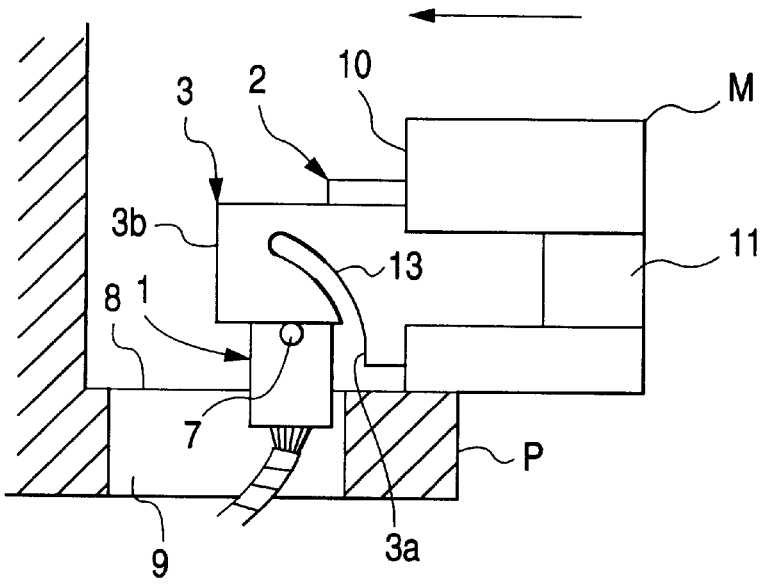
FIG. 2 is a side-elevational view showing an initial stage of an operation of connecting the gauge board to the instrument panel in FIG. 1.

First, as shown in FIG. 2, the gauge board M is put on the bottom wall 8 of the connecting portion of the instrument panel P, and is moved or advanced in a direction of an arrow.

Figure 3:
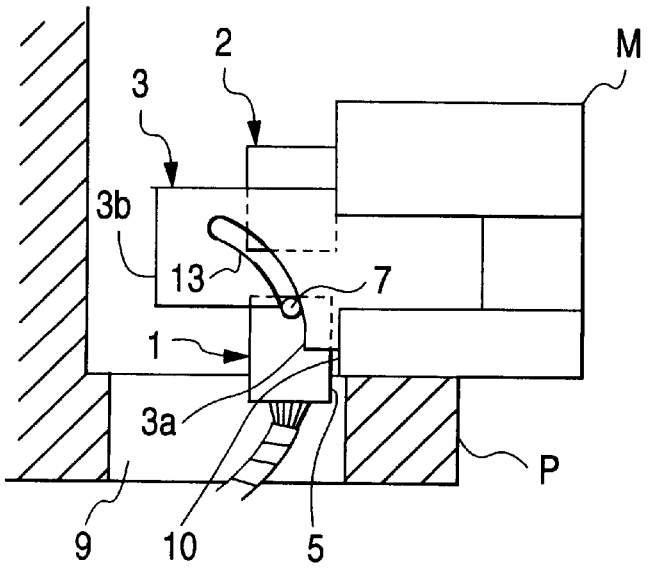
FIG. 3 is a side-elevational view showing a condition in which a driven pin of a male connector is abutted against a lower edge of a fitting lever of FIG. 2.

In accordance with the movement of the gauge board M, the lower edge 3*a* of the fitting lever 3 is brought into engagement with the driven pin 7 of the male connector 1, and also the rear surface 10 of the gauge board M is brought into engagement with the housing 5 of the male connector 1, as shown in FIG. 3.

Figure 4:
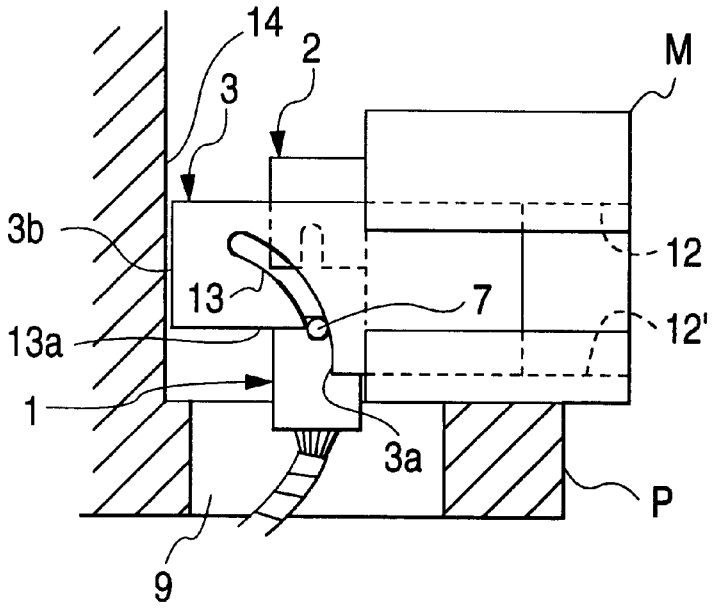
FIG. 4 is a side-elevational view showing a condition in which in accordance with the movement of the gauge board of FIG. 3, the fitting lever is abutted against an inner surface of the instrument panel.
Figure 5:
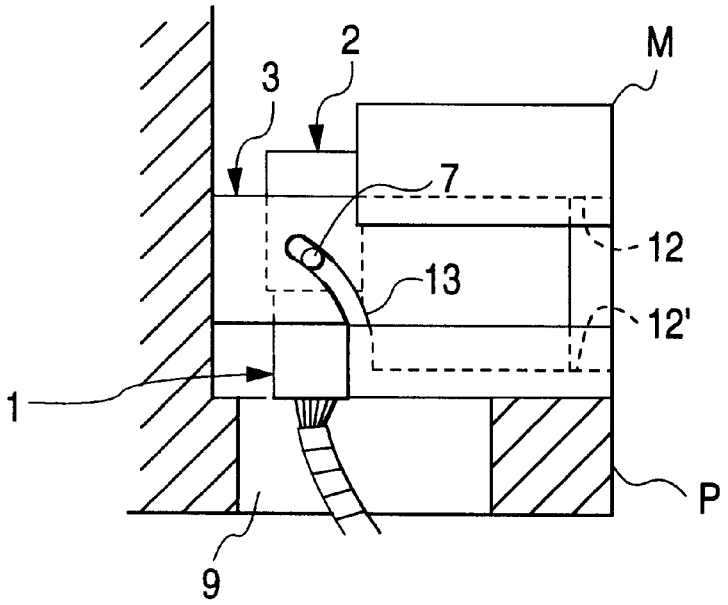
FIG. 5 is a side-elevational view showing a condition in which the two connectors are fitted together as a result of movement of the fitting lever of FIG. 4.

Then, when the gauge board M is pushed forward, the rear surface 10 of the gauge board M pushes the male connector 1 to move the same along the connector guide groove 9, so that the upper edge 3*b* of the fitting lever 3 is brought into engagement with an inner surface 14 of the connecting portion of the instrument panel P, as shown in FIG. 4.

When the gauge board M is further pushed, the fitting lever 3 moves along the guide grooves 12 and 12' in the side wall 11 of the gauge board M, and the driven pin 7 of the male connector 1 is driven upward along the cam groove 13, so that the male connector 1 is moved upward, and is fitted into the female connector 2. After the two connectors 1 and 2 are thus fitted together, the instrument panel P and the gauge board M are fastened together by bolts (not shown) passed respectively through mounting holes 15 in the gauge board M.

Figure 6:
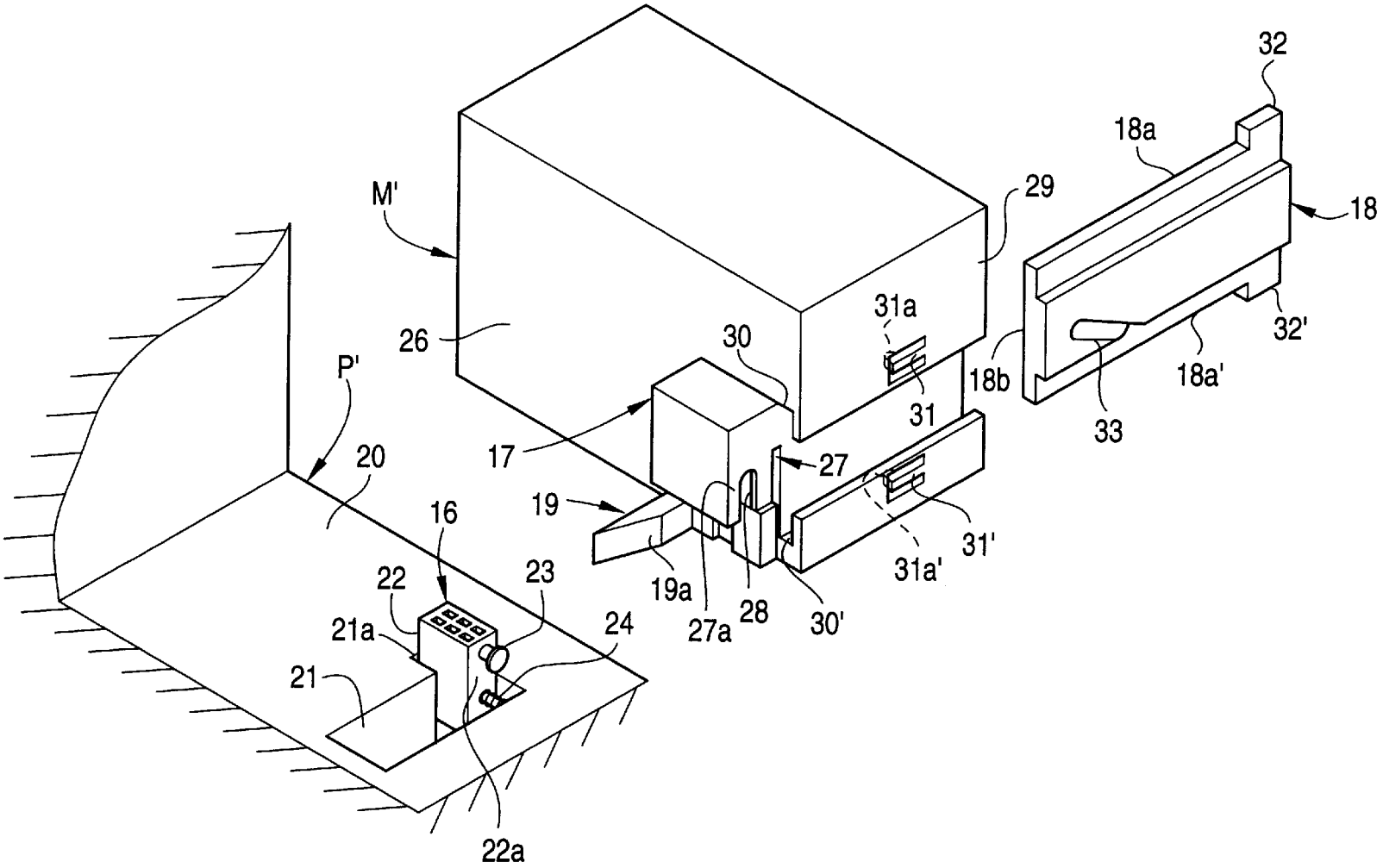
FIG. 6 is a perspective view showing another preferred embodiment of the automatic connector mutually-fitting mechanism of the invention applied to an instrument panel and a gauge board.

FIG. 6 is a perspective view showing another embodiment of the automatic connector-fitting mechanism of the invention.

The automatic connector-fitting mechanism of FIG. 6 comprises a male connector 16 projectably and retractably mounted movably in an instrument panel P', a female connector 17 fixedly mounted on a gauge board M', a fitting lever 18 movably mounted on the gauge board M', and an operating arm 19 formed on and projecting from the gauge board M'.

A connector guide groove 21 is formed in a bottom wall 20 of a connecting portion of the instrument panel P', and this connector guide groove 21 has a stand-by recess 21*a* formed at one end thereof close to the gauge board M'. The stand-by recess 21*a* serves as a receiving portion for temporarily holding the male connector 16 so that a driven pin 23 of a housing 22 will not interfere with the fitting lever 18 before the fitting operation.

Figure 7:
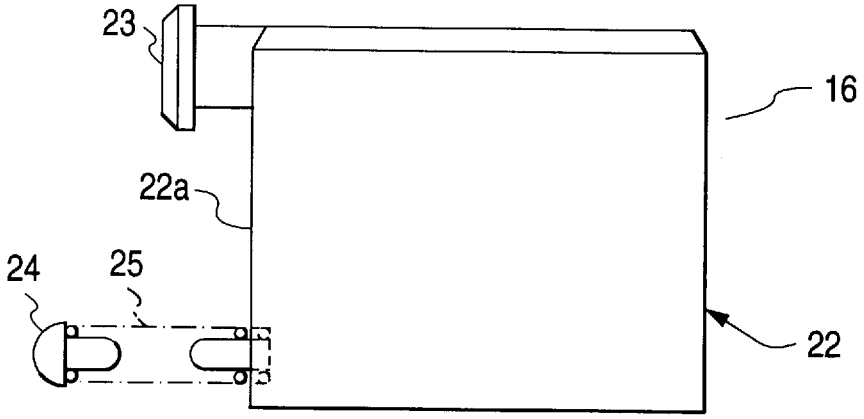
FIG. 7 is a side-elevational view showing a male connector of FIG. 6.

As shown in FIG. 7, a support projection 24 is provided projectably and retractably on a side surface 22*a* of the housing 22 of the male connector 16, and is disposed below the driven pin 23.

The support projection 24 is connected to the side surface 22*a* of the housing 22 through a spring 25, and is normally urged in a projecting direction. When the male connector 16 is received in the connector guide groove 21, the male connector 16 is urged into the stand-by recess 21*a*, and is held therein by the support projection 24.

The female connector 17 is fixedly mounted on a rear surface 26 of the gauge board M', and the operating arm 19 is formed on that portion of this rear surface 26 disposed below the female connector 17. The operating arm 19 has a distal end directed in a direction of connection of the gauge board M' to the instrument panel P', and has a slanting surface 19*a* slanting toward the fitting lever 18.

The female connector 17 is molded of a synthetic resin, and includes a tubular receiving portion 27 of a square cross-section for receiving the housing 22 of the male connector 16, and a plurality of male metal terminals (not shown) are mounted in the receiving portion 27. A guide groove 28 for receiving the driven pin 23 of the male connector 16 is formed in a side wall 27*a* of the receiving portion 27.

Opposed guide grooves 30 and 30' for receiving the fitting lever 18 are formed in a side wall 29 of the gauge board M'. Flexible retaining piece portions 31 and 31', formed by cutting the side wall 29, are provided at a substantially central portion of each of the guide grooves 30 and 30', and provisionally-retaining pawls 31*a* and 31*a'* of a convex shape are formed on an inner surface of a free end of each of the flexible retaining piece portions 31 and 31'.

The fitting lever 18 is in the form of a substantially flat plate having a convex cross-section, and provisionally-retaining projections 32 and 32' are formed respectively on opposite side edges 18*a* and 18*a'*. A cam groove 33 is formed in the fitting lever 18, and is slanting from the lower side edge 18*a'* toward a central portion of a front edge 18*b* of the fitting lever 18.

A process of fitting the two connectors 16 and 17 by moving the fitting lever 18 by mounting the gauge board M' on the instrument panel P' will now be described.

Figure 8:
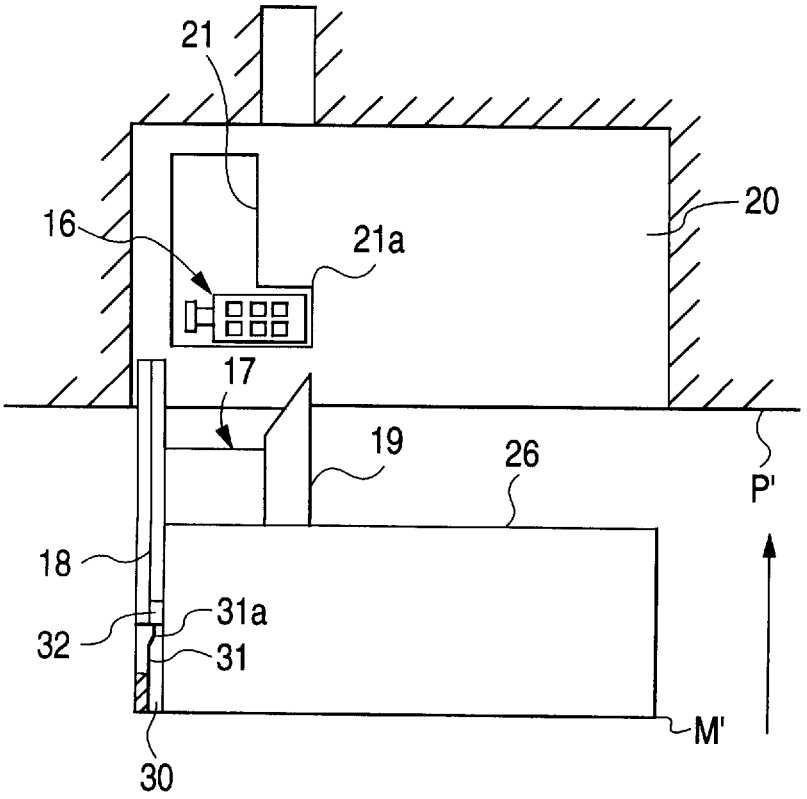
FIG. 8 is a plan view showing an initial stage of an operation of connecting the gauge board to the instrument panel in FIG. 6.

First, as shown in FIG. 8, the fitting lever 18 is fitted into the guide grooves 30 and 30' in the gauge board M', and the provisionally-retaining projections 32 and 32' of the fitting lever 18 are retainingly engaged respectively with the provisionally-retaining pawls 31*a* and 31*a'* of the flexible retaining piece portions 31 and 31', thereby holding the fitting lever 18 in a provisionally-retained condition.

Then, the gauge board M' is moved toward the male connector 16 along the bottom wall 20 of the instrument panel P'.

Figure 9:
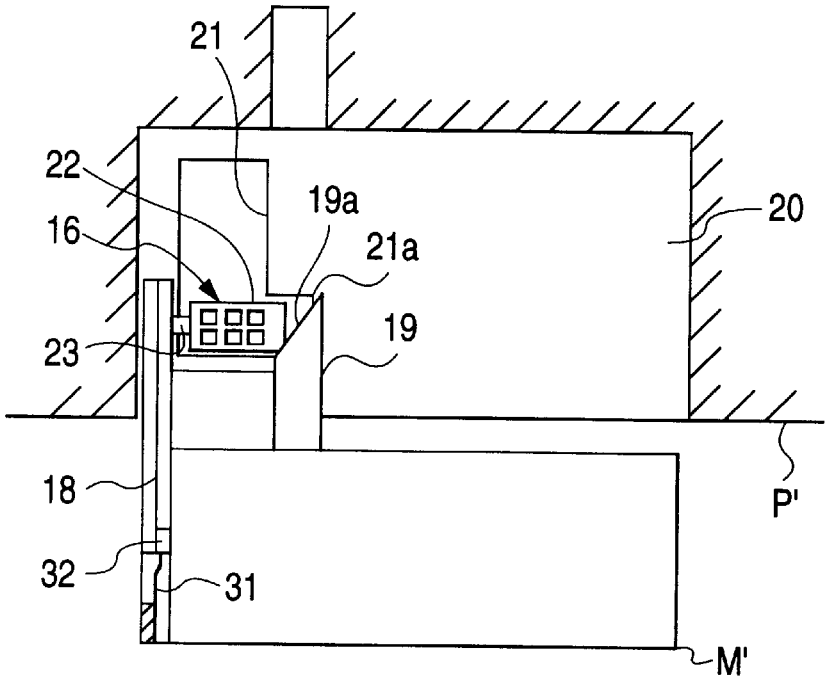
FIG. 9 is a plan view showing a condition in which an operating arm of the gauge board of FIG. 8 is abutted against a housing of the male connector.

When the gauge board M' is pushed in a direction of an arrow, the slanting surface 19*a* of the operating arm 19 is brought into engagement with a corner of the housing 22 of the male connector 16, held in the stand-by recess 21*a*, as shown in FIG. 9, and in accordance with the movement of the operating arm 19, the slanting surface 19*a* and the housing 22 slidingly move relative to each other, thereby displacing the male connector 16 to the guide groove 21. In accordance with the movement of the male connector 16, the driven pin 23 is fitted into the cam groove 33 in the fitting lever 18.

Figure 10:
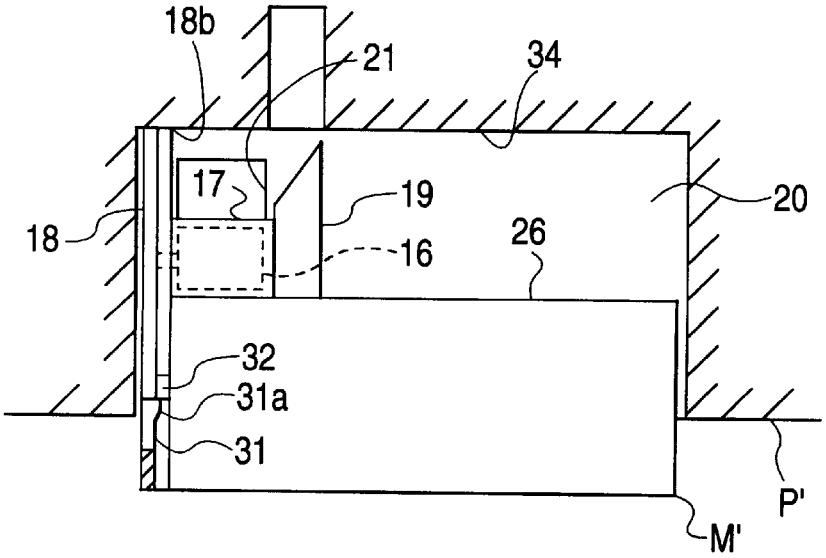
FIG. 10 is a plan view showing a condition in which the gauge board of FIG. 9 is pushed, and a fitting lever is abutted against an inner surface of the instrument panel.
Figure 11:
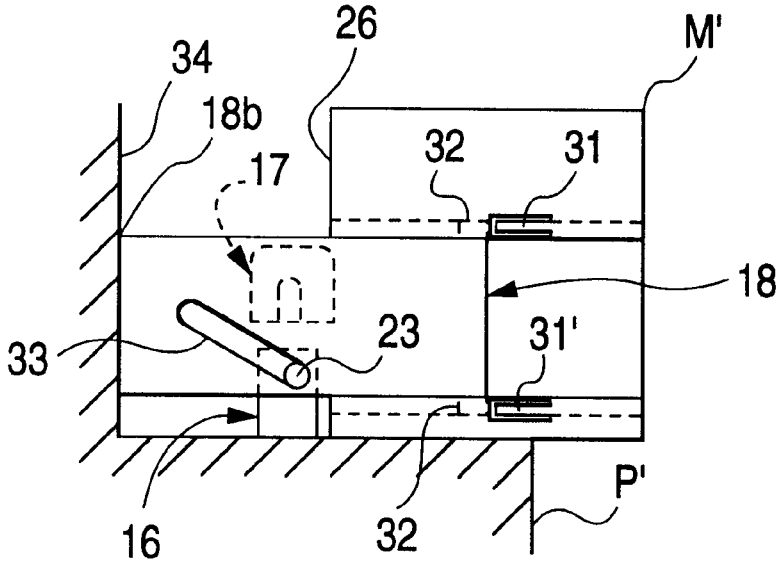
FIG. 11 is a side-elevational view showing a condition in which a driven pin of the male connector is fitted in a cam groove of the fitting lever of FIG. 10.

Then, when the gauge board M' is pushed, the housing 22 of the male connector 16 is pushed by the rear surface 26 of the gauge board M', and is moved along the connector guide groove 21, and the front end or edge 18*b* of the fitting lever 18 is brought into abutting engagement with an inner surface 34 of the connecting portion of the instrument panel P' as shown in FIGS. 10 and 11.

Figure 12:
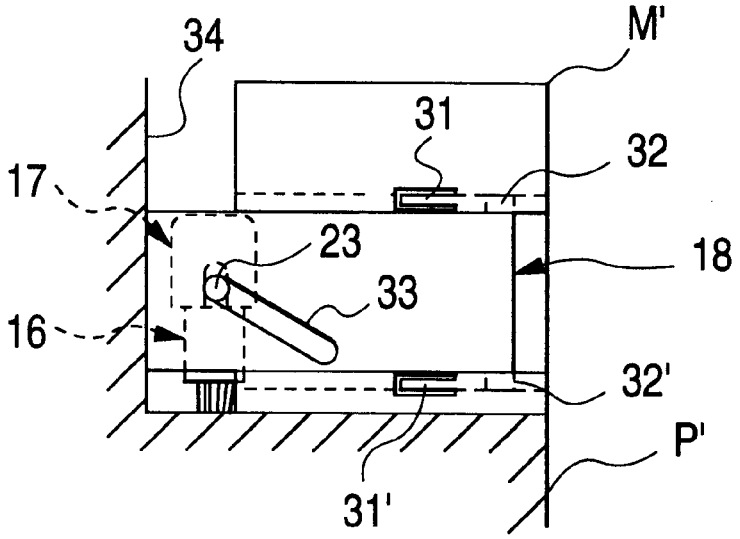
FIG. 12 is a side-elevational view showing a condition in which the two connectors are fitted together as a result of movement of the fitting lever of FIG. 11.
Figure 13:
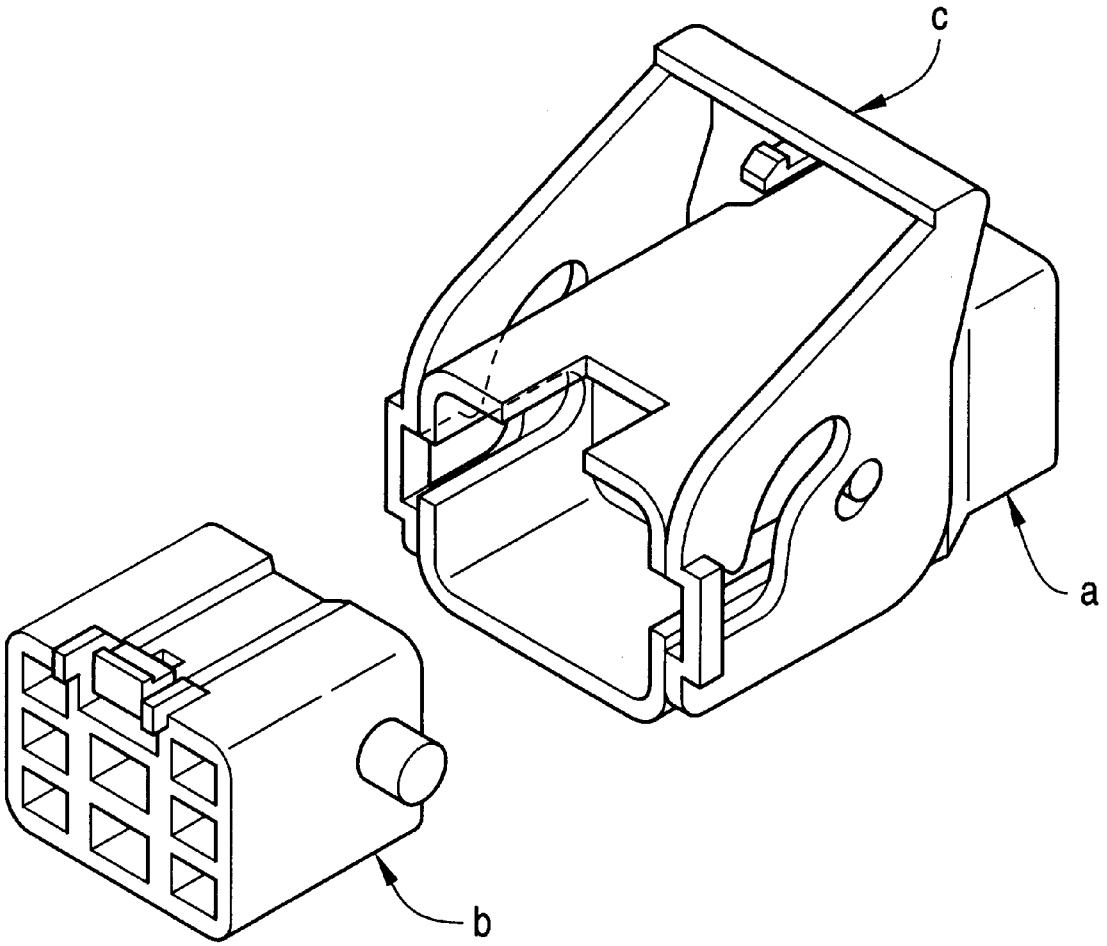
FIG. 13 PRIOR ART
FIG. 13 is a perspective view showing a conventional lever-connecting type connector.
Figure 14:
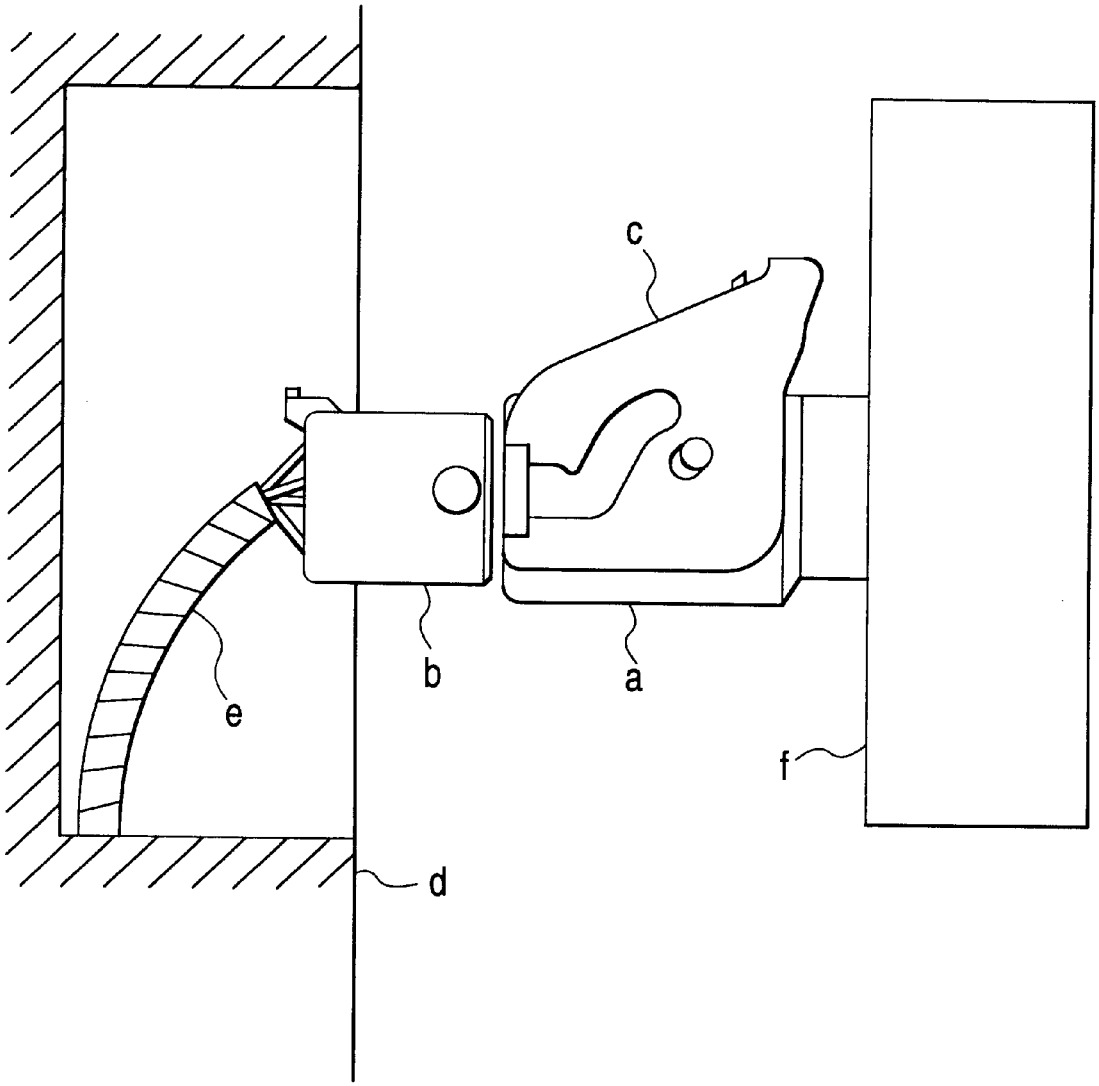
FIG. 14 PRIOR ART
FIG. 14 is a view showing the lever-connecting type connector of FIG. 13 applied to an instrument panel and a gauge board.
Figure 15:
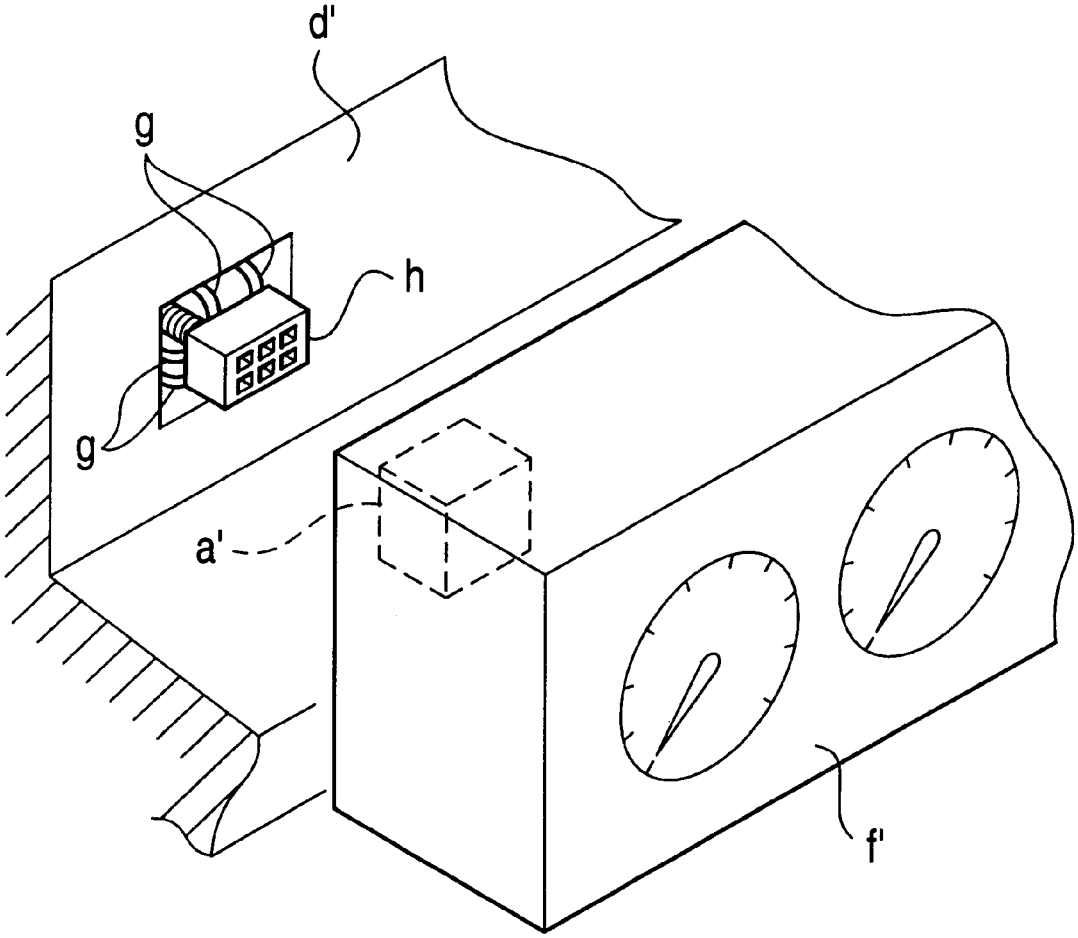
FIG. 15 PRIOR ART
FIG. 15 is a perspective view showing a conventional connecting mechanism using a receiving connector.

When the gauge board M' is further pushed, the provisionally-retaining projections 32 and 32' of the fitting lever 18 slide respectively over the provisionally-retaining pawls 31*a* and 31*a'* of the flexible retaining piece portions 31 and 31', with the fitting lever 18 kept abutted against the inner surface 34 of the instrument panel P', so that these projections 32 and 32' are disposed forwardly of the pawls 31*a* and 31*a'*, respectively. In accordance with the movement of the fitting lever 18 relative to the gauge board M', the driven pin 23 of the male connector 16 is driven along the cam groove 33, so that the male connector 16 is moved upward, and is fitted into the female connector 17 as shown in FIG. 12.

In the present invention, the fitting lever does not need to be manually operated, and the two connectors can be fitted together by the operation of connecting the two structural members together. Therefore, the operation, in which the wire harness is drawn out, and the two connectors are fitted together, and the operation of the lever, are omitted, and the production efficiency of the connecting operation is greatly enhanced, and besides an excess length of the wire harness is unnecessary, thus saving the member, and further an accident such as the biting of the wire harness during the connecting operation is prevented. Thus, many advantages are achieved.

What is claimed is:

1. An automatic connector mechanism comprising:

first and second structural members to be connected together;

first and second connectors to be fitted together, said first connector being projectably and retractably mounted movably on said first structural member, a driven pin being formed on and projecting from a housing of said first connector, and said second connector being fixedly secured to said second structural member in opposed relation to said first connector; and a fitting lever having a cam groove and movably mounted on said second structural member, wherein said first connector is moved together with said second structural member, and said fitting lever is moved relative to said second structural member, with one end of said fitting lever abutted against a wall of said first structural member, so that said driven pin is fitted in said cam groove and is driven, thereby fitting said connectors together.

2. The automatic connector mechanism according to claim 1, wherein a connector guide groove is formed in a wall of a connecting portion of said first structural member, said first connector is projectably and retractably mounted movably in said connector guide groove, said second connector is fixedly secured to a rear surface of said second structural member, and said fitting lever is movably mounted in a guide groove formed in a side surface of said second structural member.

3. The automatic connector mechanism according to claim 1, wherein a connector guide groove having a stand-by recess is formed in a wall of a connecting portion of said first structural member, a resilient support projection is provided on the housing of said first connector, and an operating arm having a slanting surface is provided on said second structural member, and wherein at an initial stage of the connection between said structural members, said first connector is held in said stand-by recess, so that said driven pin of said housing is held out of contact with said fitting lever, and as the connection between said structural members proceeds, said housing and the slanting surface of said operating arm slidingly move relative to each other, so that said housing is displaced toward said fitting lever so as to fit said driven pin into said cam groove.

4. The automatic connector mechanism according to claim 3, wherein a provisionally-retaining projection is formed on said fitting lever, and a flexible retaining piece portion having a provisionally-retaining pawl is provided at a guide groove provided in said second structural member.

5. The automatic connector mechanism according to claim 1, wherein said fitting lever has a first portion with a first height and a second portion with a second height, said first height being shorter than said second height, and said first portion being separated from said second portion by said cam groove.

6. An automatic connector mechanism comprising:

first and second connectors to be fitted together, said first connector being projectably and retractably mounted movably on a first structural member and having a pin formed on and projecting from a housing of said first connector, and said second connector being fixedly secured to a second structural member in opposed relation to said first connector; and a lever having a cam groove and slidably mounted on said second structural member, wherein said first connector is moved together with said second structural member, and said lever is moved relative to said second structural member, with one end of said lever abutted against a wall of said first structural member, so that said pin is fitted in said cam groove and is driven, thereby fitting said connectors together.

7. The automatic connector mechanism according to claim 6, wherein a connector guide groove is formed in a wall of a connecting portion of said first structural member, said first connector is projectably and retractably mounted movably in said connector guide groove.

8. The automatic connector mechanism according to claim 6, wherein said second connector is fixedly secured to a rear surface of said second structural member.

9. The automatic connector mechanism according to claim 6 wherein, said lever is movably mounted in a guide groove formed in a side surface of said second structural member.

10. The automatic connector mechanism according to claim 6, wherein a connector guide groove having a stand-by recess is formed in a wall of a connecting portion of said first structural member, a resilient support projection is provided on the housing of said first connector, and an operating arm having a slanting surface is provided on said second structural member, and wherein at an initial stage of the connection between said structural members, said first connector is held in said stand-by recess, so that said pin of said housing is held out of contact with said lever, and as the connection between said structural members proceeds, said housing and the slanting surface of said operating arm slidingly move relative to each other, so that said housing is displaced toward said lever so as to fit said pin into said cam groove.

11. The automatic connector mechanism according to claim 6, wherein a provisionally-retaining projection is formed on said lever, and a flexible retaining piece portion having a provisionally-retaining pawl is provided at a guide groove provided in said second structural member.

12. The automatic connector mechanism according to claim 11, wherein said fitting lever has a first portion with a first height and a second portion with a second height, said first height being shorter than said second height, and said first portion being separated from said second portion by said cam groove.

13. An automatic connector mechanism comprising:

first and second connectors to be fitted together, said first connector being projectably and retractably mounted movably on a first structural member and having a pin formed on and projecting from a housing of said first connector, and said second connector being fixedly secured to a second structural member in opposed relation to said first connector; and a flat plate lever having a cam groove and slidably mounted on said second structural member, said lever having first portion with a first height and a second portion with a second height, said first height being shorter than said second height, wherein said first connector is moved together with said second structural member, and said fitting lever is moved relative to said second structural member, with one end of said fitting lever abutted against a wall of said first structural member, so that said pin is fitted in said cam groove and is driven, thereby fitting said connectors together.

14. The automatic connector mechanism according to claim 13, wherein a connector guide groove is formed in a wall of a connecting portion of said first structural member, and said first connector is projectably and retractably mounted movably in said connector guide groove.

15. The automatic connector mechanism according to claim 13, wherein said second connector is fixedly secured to a rear surface of said second structural member.

16. The automatic connector mechanism according to claim 13, wherein said lever is movably mounted in a guide groove formed in a side surface of said second structural member.

17. The automatic connector mechanism according to claim 13, wherein a connector guide groove having a stand-by recess is formed in a wall of a connecting portion of said first structural member, a resilient support projection is provided on the housing of said first connector, and an operating arm having a slanting surface is provided on said second structural member, and wherein at an initial stage of the connection between said structural members, said first connector is held in said stand-by recess, so that said pin of said housing is held out of contact with said lever, and as the connection between said structural members proceeds, said housing and the slanting surface of said operating arm slidingly move relative to each other, so that said housing is displaced toward said lever so as to fit said pin into said cam groove.

18. The automatic connector mechanism according to claim 13, wherein a provisionally-retaining projection is formed on said lever, and a flexible retaining piece portion having a provisionally-retaining pawl is provided at a guide groove provided in said second structural member.

* * * * *

UNITED STATES PATENT AND TRADEMARK OFFICE

CERTIFICATE OF CORRECTION

PATENT NO. : 5,957,707
DATED : September 28, 1999
INVENTOR(S) : Shinji Kodama

It is certified that error appears in the above-identified patent and that said Letters Patent is hereby corrected as shown below:

Item [30] FOREIGN APPLICATION PRIORITY DATA:

--Sep. 2, 1996 [JP] Japan .....8-231889--

Signed and Sealed this

Twenty-sixth Day of June, 2001

*Attest:*

Nicholas P. Godici

NICHOLAS P. GODICI

*Attesting Officer*

*Acting Director of the United States Patent and Trademark Office*